US009120102B2

(12) United States Patent
Bentaj et al.

(10) Patent No.: US 9,120,102 B2
(45) Date of Patent: Sep. 1, 2015

(54) METHOD AND SYSTEM FOR REUSING MATERIAL AND/OR PRODUCTS BY PULSED POWER

(75) Inventors: Abdelaziz Bentaj, Villeneuve la Garenne (FR); Nadir Quayahya, Palaiseau (FR); Jean-Louis Clement, Paris (FR); Marc Burey, Colombes (FR)

(73) Assignee: CAMILLE COMPAGNIE D'ASSISTANCE MINIERE ET INDUSTRIELLE, Saint Ouen L'Aumone (FR)

( * ) Notice: Subject to any disclaimer, the term of this patent is extended or adjusted under 35 U.S.C. 154(b) by 597 days.

(21) Appl. No.: 13/392,070

(22) PCT Filed: Jul. 7, 2010

(86) PCT No.: PCT/EP2010/059704

§ 371 (c)(1),
(2), (4) Date: May 1, 2012

(87) PCT Pub. No.: WO2011/023443

PCT Pub. Date: Mar. 3, 2011

(65) Prior Publication Data

US 2012/0205472 A1 Aug. 16, 2012

(30) Foreign Application Priority Data

Aug. 26, 2009 (FR) ..... 09 55819

(51) Int. Cl.
*B02C 19/00* (2006.01)
*B02C 19/18* (2006.01)

(52) U.S. Cl.
CPC ..... *B02C 19/18* (2013.01); *B02C 2019/183* (2013.01)

(58) Field of Classification Search
CPC ..... B02C 19/18; B02C 2019/183
USPC ..... 241/1, 21, 23
See application file for complete search history.

(56) References Cited

U.S. PATENT DOCUMENTS

| | | | | |
|---|---|---|---|---|
| 7,246,761 | B2 * | 7/2007 | Hoppe et al. | 241/1 |
| 2006/0163392 | A1 * | 7/2006 | Hoppe et al. | 241/1 |

FOREIGN PATENT DOCUMENTS

| | | | |
|---|---|---|---|
| DE | 10 2004 041 287 | A1 | 3/2006 |
| DE | 10/2005/061 822 | A1 | 6/2007 |
| JP | 2007-504937 | | 3/2007 |
| JP | 2007-507332 | | 3/2007 |
| WO | WO 02/47803 | A2 | 6/2002 |
| WO | WO 03/049865 | A1 | 6/2003 |
| WO | WO 2009/089351 | A1 | 7/2009 |

* cited by examiner

*Primary Examiner* — Faye Francis
(74) *Attorney, Agent, or Firm* — Blakely Sokoloff Taylor & Zafman

(57) ABSTRACT

A method for reusing material by pulsed power, according to which a series of electrical discharges are generated between at least two electrodes in a reactor receiving an ambient liquid as well as the materials to be reused. The series of said electrical discharges produce, as a result of the energy, the frequency of the electrical discharges, the voltage between the electrodes and the switching time, a mechanical shock-wave which propagates over the materials to be processed in the reactor. The ambient liquid is cooled by a continuous or carousel cooling system, to enable the production of nano-particles.

18 Claims, 7 Drawing Sheets

Table 1

| Granulometry of the diamond (μm) | 180 - 300 | 50 - 70 | 20 - 50 |
|---|---|---|---|
| Degree of abrasivity (median) | 1.39 | 1.55 | 1.63 |
| Degree of abrasivity (average) | 1.42 | 1.73 | 1.79 |

METHOD AND SYSTEM FOR REUSING MATERIAL AND/OR PRODUCTS BY PULSED POWER

This is a non-provisional application claiming the benefit of International application number PCT/EP2010/059704, filed Jul. 7, 2010.

The invention relates to a method and a system for reusing materials and/or products by pulsed power.

It has application in the field of nanoparticles, typically for the crushing of diamond particles.

The crushing of materials plays an important role in many methods for manufacturing or processing materials. The conventional methods however have disadvantages which have led to the development of new solutions.

The crushing of materials by electrical discharges is a known method, having many advantages in relation to the conventional methods using mechanical crushers, for which the wear of parts deteriorates the output of the system.

Examples of this have in particular been described in the following various patents or patent applications: JP 10-180133; WO 2008/017172; WO 2005/032722; U.S. Pat. No. 4,540,127; CA 2 555 476; EP 1 375 004.

Conventionally, a succession of electrical pulses of very high power is applied to the products and materials immersed beforehand in an ambient liquid medium.

The resistivity of the ambient liquid as well as the transient state of the material during the pulses results in the passing of electric arc channels charged with energy inside the immersed material and between the grains of said material, until the creation of a single or multiple electric arc between the two electrodes and passing through said immersed material.

The passing of the electric arc through said material results in the dislocation of grains on discontinuity points (spallings, inclusions, fractures), on intergranular contacts, and the rupture of certain chemical bonds followed by the chemical recombination of elements and molecules thus released into new compounds in phase equilibrium with the ambient medium.

However, the conventional methods of crushing for obtaining materials on a nanometric scale do not have satisfactory results in terms of output.

A method for reusing and an improved polyfunctional system are described in patent application FR 09 50945, not yet published.

GENERAL PRESENTATION OF THE INVENTION

A purpose of the invention is to propose a further improved method for reusing materials and/or products by pulsed power, in particular in terms of processing time and energy costs, and making it possible to obtain materials on a nanometric scale with a high output and a lesser cost in relation to prior art.

An even further purpose of the invention is to make possible a release of elements constituting products and/or materials by fragmentation, pulverising, and where applicable electrokinetic and electrochemical separation, even by chemical recombinations of some of these elements, without making use of complicated and polluting pyrometallurgical or chemical treatments.

In particular, the invention proposes a method for reusing materials by pulsed power according to which a succession of electrical discharges is generated between at least two electrodes in a reactor receiving an ambient liquid as well as materials to be reused, characterised in that the succession of said electrical discharges produces, due to the energy, the frequency of the electrical discharges, as well as due to the voltage between the electrodes and the switching time, a mechanical shockwave which propagates over the materials and/or products to be processed in the reactor, and in that, during the implementation of said method, said ambient liquid is cooled by a continuous or carousel cooling system, said method making it possible to obtain materials on a nanometric scale.

As a supplement where applicable, after a first step of weakening by the mechanical shockwave produced as such, the products and/or materials are subjected to a succession of electrical discharges of which the energy, the voltage between the electrodes that generate them, the switching time and the discharge frequency are selected in such a way that said discharges carry out a crushing of material by direct effect of the electrical discharges.

The method can further comprise a step of collecting the materials resulting from the crushing according to the diameter of the particles by the cooling system, said materials resulting from the crushing being in suspension in the ambient liquid.

This mechanical shockwave which propagates in the reactor and where applicable the additional electric arc make it possible to obtain the fragmentation, separation, pulverising of the materials and/or products to be processed, and favour the chemical recombination of a few constituents or molecules.

The invention also proposes an adapted system for the implementation of this method.

In all of this text, material and/or product means any biphasic or monophasic substance or material (solid, liquid, gas, vapour, etc.), mono- or pluri-constituent, pure or composite, able to contain amorphous or crystallisation solids; for example (incomplete list): mineral, ore, waste or by-product of one or several activities, in particular industrial or human activities, any product having to undergo an operation of crushing, fragmentation, pulverising, breaking, separation into its constituents, decontamination, reuse with as an objective an increase in its value added, composite materials with a base of carbon fibres or of resin and metals (titanium, steel, alloys).

The method and the system described have a particular application for the obtaining of irradiated diamond nanoparticles.

Such a method has the advantage of avoiding the use of mechanical moving parts (the case with mechanical crushers), balls, bars or other wear parts (ball, bar, cone crushers). This results in a reduction in the costs of maintenance for this method in relation to other methods.

Another advantage of this method relates to the non-utilisation of highly toxic chemicals and inorganic reagents which are often required for the processing of ores.

Another advantage of this method is that the release, fragmentation, separation, pulverising occur in a very brief time period thanks to the switching time of the spark gaps which trigger the discharge of the capacitors which make it possible to return the stored energy in very brief time periods (very high pulsed power) to the reactor containing the products to be processed and/or reused, this for a very low total energy consumption.

Advantageously, after a first step of weakening by the mechanical shockwave produced as such, the products and/or materials are subjected to a succession of electrical discharges of which the energy, the intensity, the voltage between the electrodes that generate them, the time and discharge frequency are selected in such a way that said discharges carry out a crushing of material by direct effect of the electrical discharges (electric arcs). Also, the invention proposes a system for reusing that implements such a method.

PRESENTATION OF THE FIGURES

Other characteristics, purposes and advantages of the invention shall appear in the following description, which is purely illustrative and not restrictive, and which must be read along with the annexed drawings, wherein.

Figure 4A:
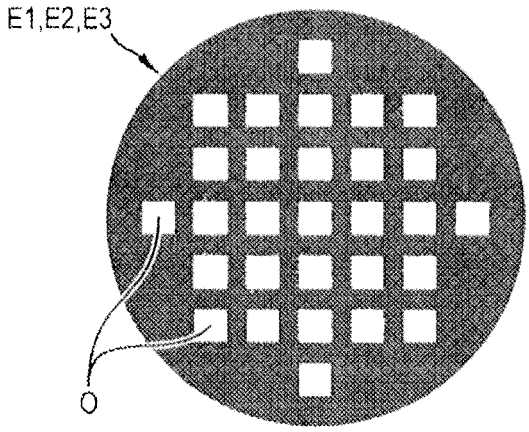
Figure 4B:
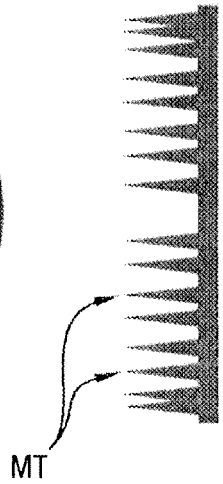
Figure 5A:
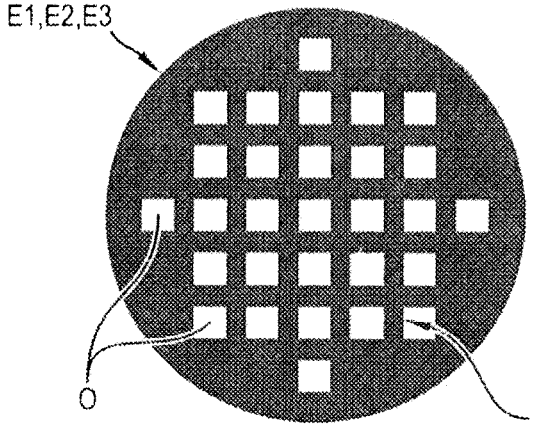
Figure 5B:
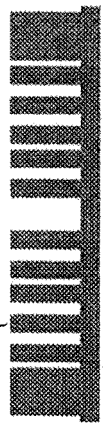
Figure 6:
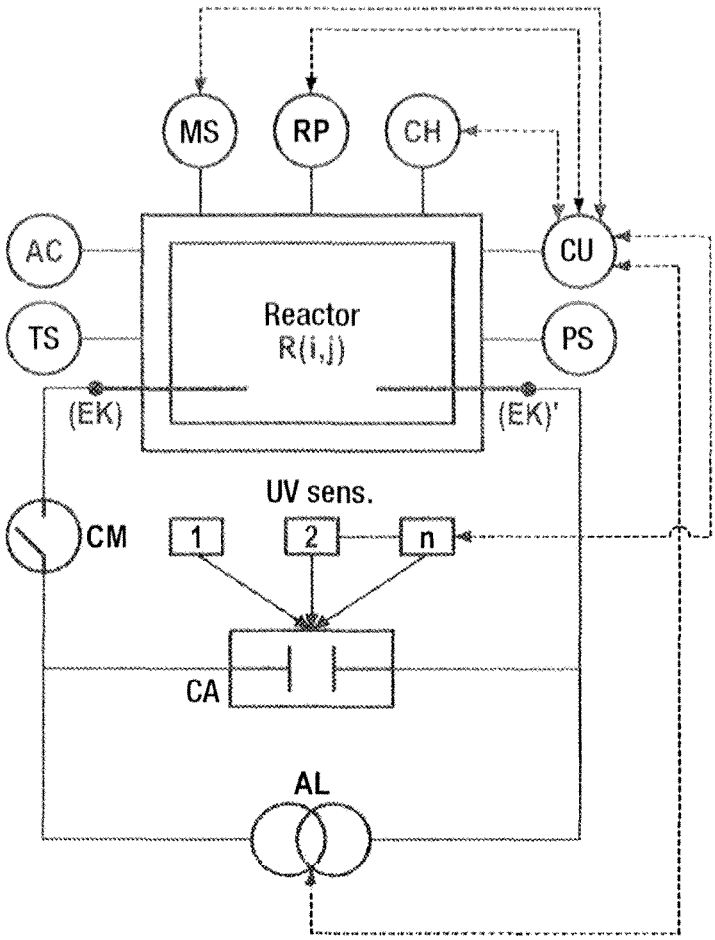

FIGS. 4*a* and 4*b* show a type of multi-tip electrode having tapered rods;

FIGS. 5*a* and 5*b* show a type of multi-tip electrode for which the rods have square sections;

FIG. 6 shows a polyfunctional system control assembly.

Figure 7A:
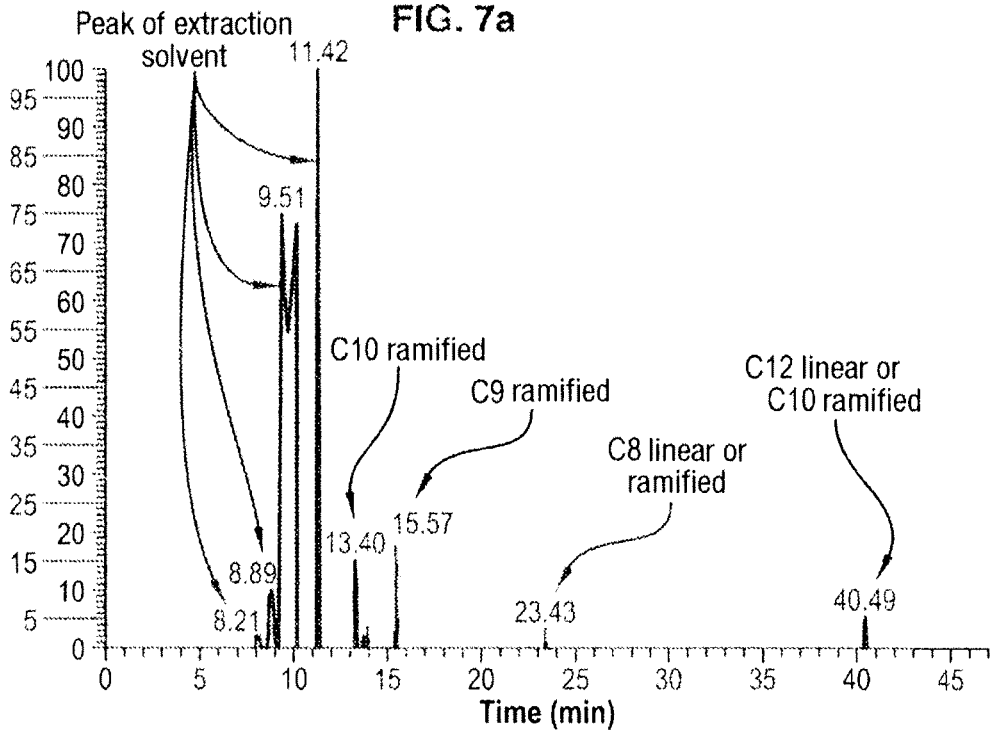

FIG. 7*a* shows a qualitative analysis by gas chromatography combined with flame ionization detection (GC-FID).

Figure 7B:
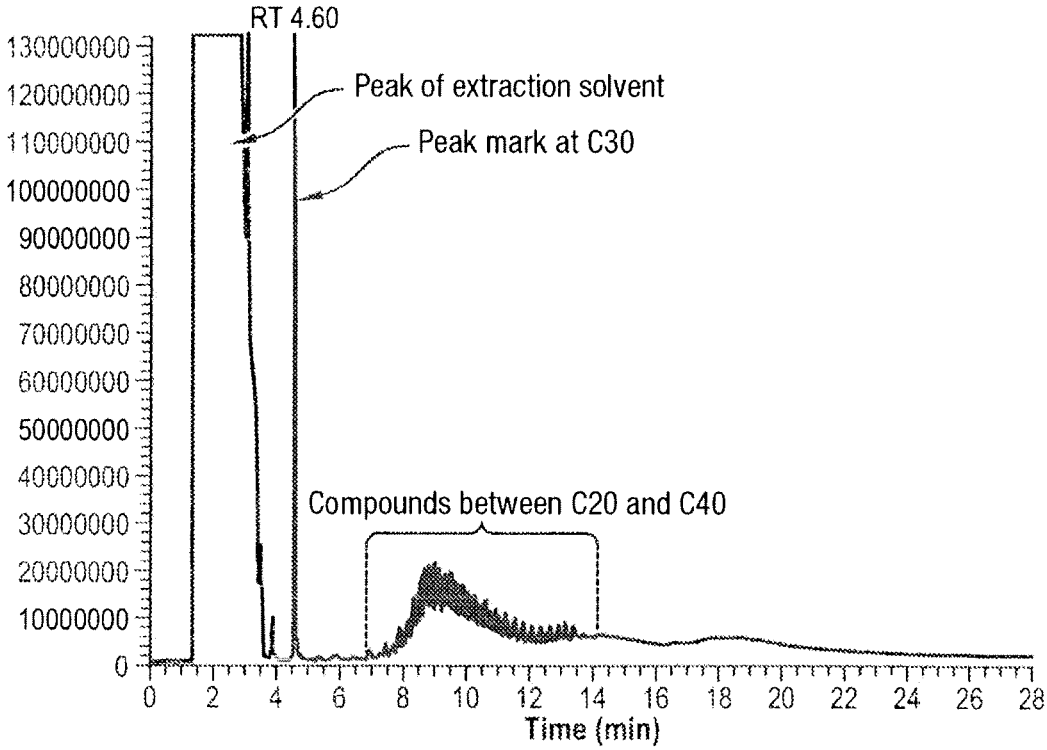

FIG. 7*b* shows an analysis by gas chromatography combined with a mass spectrometric detection (GC-MS).

Table 1 shows the degree of abrasivity of the diamond particles according to the granulometry.

Figure 8:
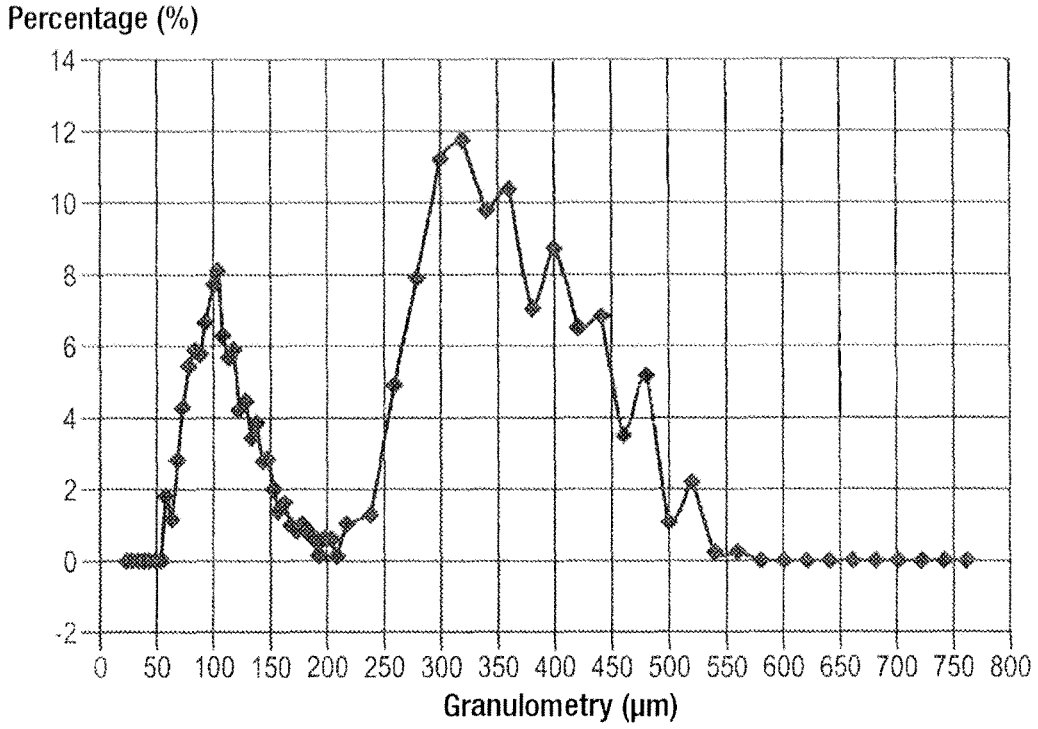

FIG. 8 has a grading curve of the fragmentation of the diamond powder.

Figure 9:
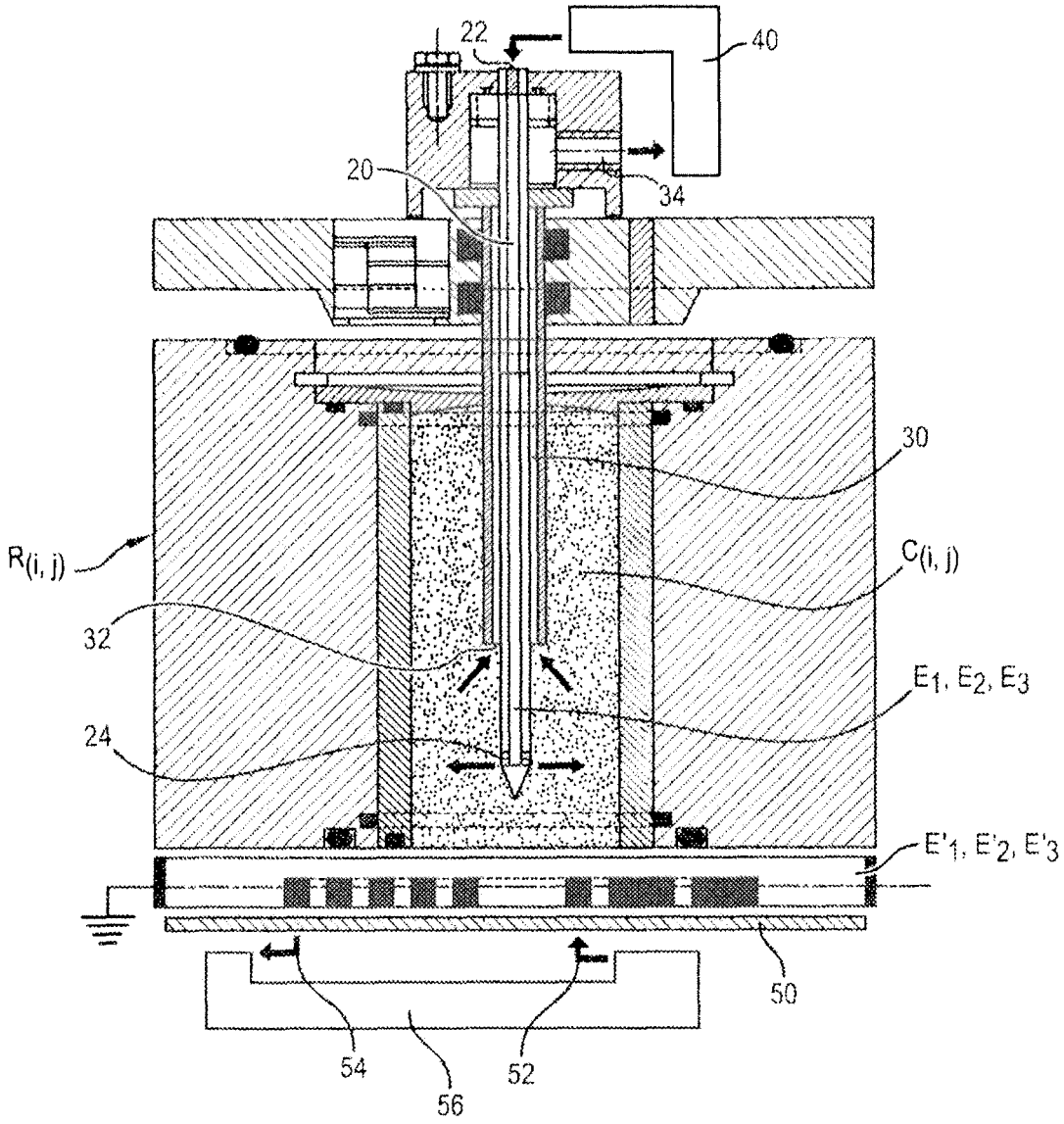

FIG. 9 shows a reactor for the production of nanoparticles with a cooling system of the electrodes.

DESCRIPTION OF ONE OR SEVERAL EMBODIMENTS OR IMPLEMENTATIONS

1. Examples of an Embodiment of a Polyfunctional System

The polyfunctional system presented hereinafter is similar to the one described in patent application FR 09 50945, not yet published.

1.1. Stages and Reactors

Figure 1:
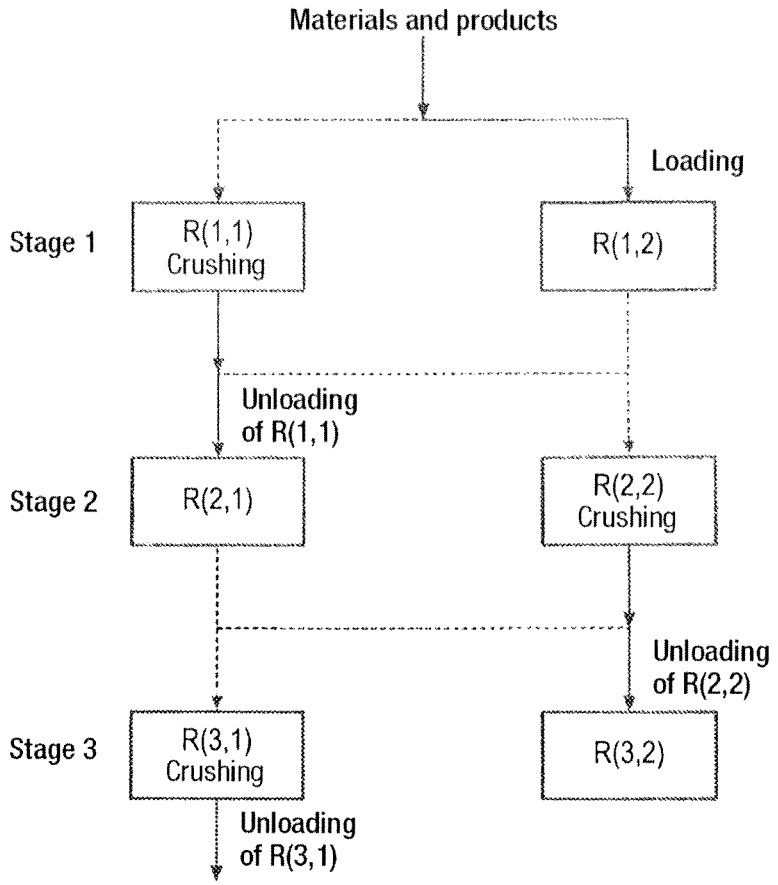
FIG. 1 shows a diagram of the triple-stage polyfunctional system.

The polyfunctional system for reusing materials and/or products such as shown in FIG. 1 comprises several reactor stages in series, here three.

In the example of this figure, each stage comprises two reactors, which are referenced R(i,j) in the figure, where i and j are dummy indexes which are integers such that $1 \leq i \leq 3$ and $1 \leq j \leq 2$, the reactors being distributed into three stages (i) in series:

Stage 1: R(1,1) and R(1,2)—indirect effect (mechanical shockwave).

Stage 2: R(2,1) and R(2,2)—direct effect (dislocation via electric arc).

Stage 3: R(3,1) and R(3,2)—drying.

The stage 1 of processing by mechanical shockwave makes it possible to embrittle by shockwave the materials and/or products to be reused. The materials or products weakened as such are then fragmented and pulverised in a second step in the stage 2 (direct effect of the electric arc). The stage 3 is a stage of drying.

The Stage 1—Indirect Effect

The stage 1—with indirect effect—comprises two reactors in parallel, operating in a shifted cycle. A reactor (here R(1,1)) is activated while the other (R(1,2)) is in phase of loading or unloading materials and/or products.

The mechanical shockwave is generated in the reactor which operates, by rapid discharge of electrical energy in the reaction medium (Newtonian or non-Newtonian ambient liquid).

Figure 2:
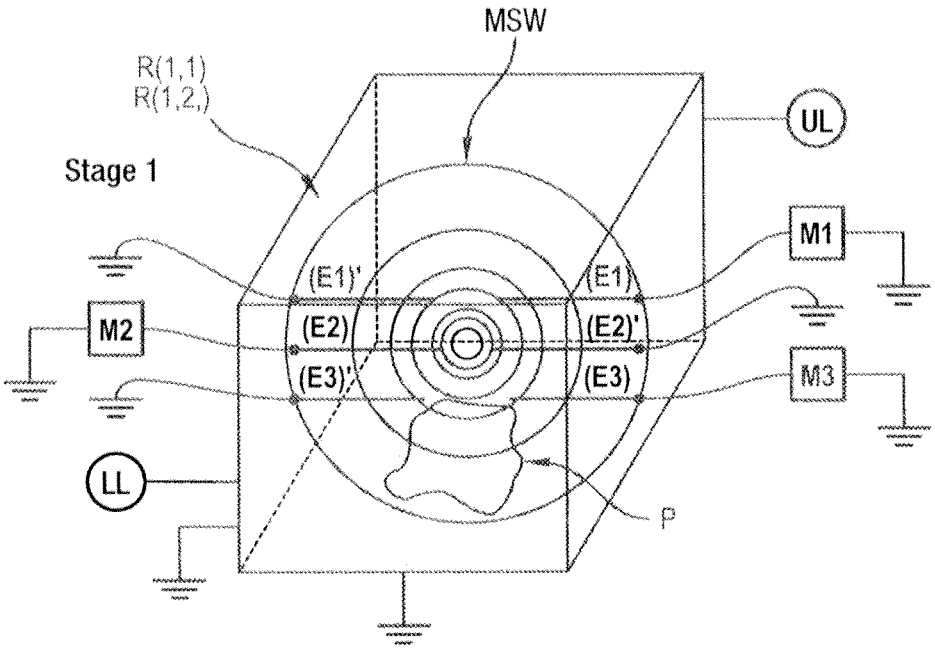
FIG. 2 shows a diagram of a reactor based on the indirect effect.
Figure 3:
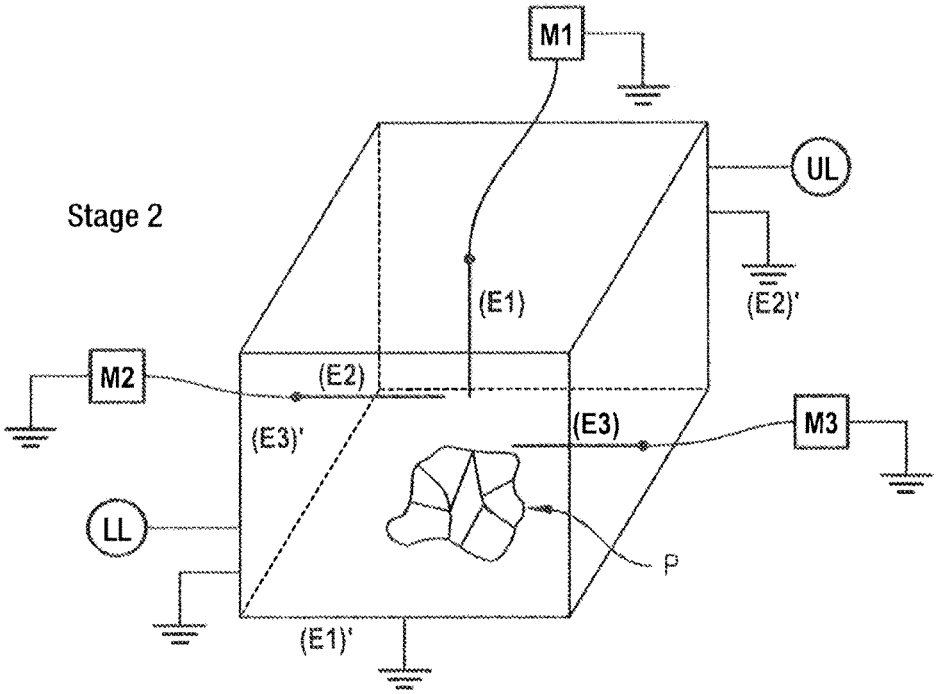
FIG. 3 shows a diagram of a reactor based on the direct effect.

As shown in FIG. 2, the reactors R(1,1) and R(1,2) (Stage 1) comprise several pairs of electrodes, here three pairs of triaxial electrodes (E1,E'1), (E2,E'2), (E3,E'3) (FIG. 3). Each pair is associated with a high voltage power supply module M1, M2, M3 and comprises on the one hand a multi-tip electrode E1, E2, E3 connected to the positive terminal of the corresponding high voltage electrical module M1, M2, M3; the other electrode E'1, E'2, E'3 is flat and connected to the mass (ground).

The distance between two electrodes (E1,E'1), (E2,E'2), (E3,E'3) of the same pair is selected lower than the threshold distance in order to generate an electrical discharge (threshold distance which depends on the electric breakdown field and on the applied voltage between the anode and the cathode).

The ambient liquid which contains the materials to be processed and/or reused is for example water of which the phase change properties according to the electrical voltage and the pulse duration are known. Any other Newtonian or non-Newtonian liquid of known or measurable resistivity can of course be used. FIG. 2 shows a low level LL and a high level HL between which the level of the liquid in the reactor must be located.

The shape, the dimension of the reactors R(1,1) and R(1,2), as well as those of the electrodes are selected according to the application considered and the materials and/or products to be processed.

The use of a reactor with a concave spherical bottom amplifies the effect of the shockwave generated by the electrical discharges with the reflections on the spherical wall of the reactor.

The power supply modules M1, M2, M3 make it possible to store the electromagnetic energy in charge elements (high performance capacitors or/and coils: Marx generator). This energy is released into an electrical discharge circuit comprised of a reactor (for crushing and processing materials) and other components (resistances, coils, etc.) through a very fast switching system (spark gap with a switching time for example between 250 ns and 900 ns, preferably greater than 500 ns).

The voltages between electrodes are of a magnitude of several kilovolts.

The energy used for each reactor is of a magnitude of 600 joules to 50,000 joules, for example from 600 to 12000 joules according to the applications.

The operating frequency varies between 0.5 Hz and 5 Hz, variant according to the applications, for example between 1 and 2 Hz for certain applications, and between 2 and 5 Hz for other applications.

The dead time between two consecutive electrical discharges varies between 200 ms and 1 s.

With the indirect effect, an electric arc and a plasma are created, the mechanical shockwave MSW generated has a dominant effect during the crushing, breaking, fragmentation, pulverising and separation of the elements by mechanical compression on said materials and/or products to be processed.

The stirring induced by the pulses in the tank (reactor) cause a homogenisation of the fragments by facilitating their separation.

This mechanical shockwave MSW is due to a succession of overpressures (compressions) and underpressures (expansion) generated by the electrical discharges through separated electrodes. The discharge of the electrodes in an aqueous medium produces an explosion and hot plasma.

The mechanical energy transmitted by the shockwave in the medium is given by the equation (1):

$$E=\tfrac{1}{2}\rho\mu^2 \quad (1)$$

Where ρ is the density of the medium and u is the speed of the wavefront.

The intensity of the shockwave is proportional to the variation of the electrical discharge current as there is a relation between the power output in the reactor and the variation of the electrical discharge current (equation 2).

$$\frac{dE}{dt}=2\left[\frac{kst^2}{3}\left(\frac{di}{dt}\right)_{t=0}\right]^{2/3} \quad (2)$$

i(t) being the electrical discharge current in the circuit and s is the distance between the two electrodes generating the electric arc and the shockwave.

The energy of the shockwave can be written in the following form:

$$E(t)=\frac{4\pi s^2}{\rho c}\int_0^t p^2(t)\,dt \quad (3)$$

Where ρ is the density of the medium, c is the velocity of the wave in the medium, s is the length of the arc channel generated and p is the overpressure in the medium which is given by the relation (equation 4):

$$p(t)=p_0e^{-t/\tau} \quad (4)$$

$p_0$ (equation 5) being the maximum value of the overpressure produced by the shockwave and t a time-constant which depends on the electric module.

$$p_o=\frac{1}{s}\sqrt{\frac{\rho cE}{2\pi\tau}} \quad (5)$$

The Stage 2—Direct Effect

In the case with the direct effect, the electric arc passes through the liquid and passes through the materials and/or product to be reused.

The reactors R(2,1) and R(2,2) (Stage 2) each include for this purpose three pairs of tip/flat electrodes (FIG. 2) (the number of electrodes can be increased in order to amplify the effect of the electrical discharge on the material and/or product to be processed by also modifying the geometry of the reactor, for example: a polyhedron with a number of even faces, one face serves as an anode and the other across from it serves as a cathode).

In the same way as for stage 1, the electrical energy is stored in power supply modules M1, M2, M3, then released into a discharge circuit via an ultra rapid switching time with a switching time between 200 ns to 900 ns, the switches able to vary according to the applications, with for example switching time between 200 ns and 500 ns, or between 250 ns and 900 ns.

The voltages between electrodes are of a magnitude of several kilovolts. The energy used for each reactor is of a magnitude of 50 joules to 1,000 joules, able to be of a magnitude of 100 joules to 1,000 joules for certain applications.

The operating frequency varies between 1 Hz and 40 HZ, able to vary between 1 Hz and 20 Hz according to the applications.

The dead time between two consecutive electrical discharges varies between 1 ms and 1 s.

The spark gap of the stage 1 and of the stage 2 (triggers of the rapid discharge of the capacitors storing the energy) can be installed in an enclosed area, filled with an inert gas (for example: nitrogen) with two advantages:

- render the breakdown voltage independent of the existing rate of humidity,
- and allow for the recovery and evacuation of the ozone generated in a simpler manner.

This second direct effect stage makes it possible to separate the various elements constituting said materials and/or products by the passing through of the electric arc resulting in a selective separation of the elements which is due to the fact that the Newtonian or non-Newtonian medium becomes more resistant electrically than the materials and/or products to be processed during the passing of the arc, to the variation in the resistivity of the various elements constituting said materials and/or products and to the phenomenon of resonance.

In the case with the direct effect, the presence of elastomeric spheres in the reactor having a stiffness greater than 1 N/cm and where applicable an adjusted viscous damping coefficient (more preferably between 0.5 and 2 N·s/m) makes it possible to improve the processing and the reusing of the products. These elastomers lessen the effect of the shockwave, which favours the effect of the electric arc, resulting in better effectiveness with the direct effect (Stage 2).

The Stage 3—Drying Via Microwaves

The reactors R(3,1) and R(3,2) each comprise a microwave generator.

The third stage is used for drying materials and/or products by thermal induction due to the microwaves generated by this microwave generator.

This facilitates for example the separation of the elements constituting the materials and/or products once fragmented without recourse to conventional methods of drying which are costly.

The three stages mentioned hereinabove can however be used in any order.

For example, the stage of drying can be used, prior to crushing by direct effect—for example before or after the embrittlement by indirect effect—for the embrittlement of said materials and/or products by evaporation of pockets of water present inside, which facilitates the crushing and the separation in the stage of processing by direct effect.

Also, one or two stages (i) are able to not be used.

A further alternative, the three stages hereinabove can be modified into a continuous system, which retaining the phenomena that postpone the reusing of materials and products.

The effectiveness of the method (direct and indirect) is connected to the geometric configuration of the electrodes and of the reactor, to the energy content and to the chronological profile of the system of shockwaves generated.

Note that:

- vapour bubbles form locally in the liquid medium (expansion) and disappear after (implosion). The energy released in the implosion phase is greater than that released in the expansion phase.
- the adjusting of the operating parameters makes it possible to solicit the material or product to be reused in such a way as to:
  - excite simultaneously the highest number possible of modes proper to the material or product.

approach a practically instantaneous strain (Dirac), with an oscillatory profile limited over time.

reach an acoustic impedance in the material or product to be reused of at least: 3 $10^6$ ($kg/m^2 \cdot s$).

In this context, the brisance of the material and/or product to be used makes it possible on the one hand to reach a sufficient rate of shearing, on the other hand to obtain a selective fragmentation, which optimises the Bond's index realised.

1.2. Multi-Electrodes and Multi-Tip Electrode

The choice of the electrodes depends on the type of application considered and of the equipment and/or product to be processed. In order to enlarge the field of exposure of said material and/or product to the electric arcs and multiply the generation of the shockwaves, several pairs of tip/tip, tip/flat or multi-tip/flat electrodes can be used in the polyfunctional system, as such the effect of crushing, fragmentation and separation varies from one configuration to another.

A better output is however obtained with a configuration of multi-tip/flat electrodes.

FIGS. 4*a*, 4*b*, 5*a* and 5*b* show two examples of multi-tip electrodes.

In the case of FIGS. 4*a* and 4*b*, this is a tapered multi-tip MT, while in the case illustrated in FIGS. 5*a* and 5*b*, these are rods of which the tops are squares (square tips ST).

The tips are themselves separated by openings O making it possible to lessen the return effect of the shockwave.

During an electrical discharge, each rod is considered as four adjacent tips which results in their self-cleaning by the passing of the electric arc (clearing of microbubbles present in the vicinity of tips).

This self-cleaning makes it possible to improve the output of crushing, fragmentation and separation of the elements constituting the materials and/or products processed.

For example, in the case of a stage of embrittlement by mechanical shockwave (indirect effect), a pair of multi-tip electrodes (FIGS. 4 and 5) and flat is introduced into a reactor; the support of the electrode contains for example 68 positions (and even more) separated by openings in order to lessen the effect of the return of the shockwave. On each position is installed a tapered tip or a rod of which the top is square which corresponds to four tips (one for each top of the square).

Note that a polyhedron shape is advantageous for the reactors, since it allows for the introduction of several pairs of electrodes in each reactor (from 1 to 15 pairs for example).

A polyhedron reactor can however be replaced with a cylindrical reactor with a concave spherical bottom where the anode has a multi-tip shape (FIGS. 4*a*, 4*b* and 5*a*, 5*b*) and where the cathode is flat.

1.3. Control System

FIG. 6 shows a control assembly of the polyfunctional system of reusing materials and/or products.

It comprises a control unit CU which controls the spark gaps CM and a high voltage generator AL which exchanges with various sensors. Marx generators are used in the case of the direct effect, and initiating electrodes are used in the case of the indirect effect. The various sensors include for example a mass spectrometer MS, a chromatograph CH, pressure and temperature sensors PS and TS, as well as UV radiation sensors.

The unit further comprises means of acquisition and operating parameters allowing for Data acquisition;

Command control;

Adjusting fundamental operating parameters in particular (incomplete list):

1. stored energy;
2. applied voltage;
3. discharge time;
4. discharge frequency;
5. peak intensity;
6. retention time in the reactor;

The effectiveness of the reduction of the dimensions of the material and/or product to be reused can be measured by the methods of the theory of comminution (Bond's index, etc.).

High voltage generator controller

The storage of the electrostatic energy in capacitors CA of the power supply module is provided by the high voltage generator AL. This generator AL is controlled remotely by the same numerical control of the control system of the polyfunctional system (control unit CU). With this type of generator, there is a possibility of increasing the voltage threshold of the triggering of the first spark gap in the electric circuit and which initiates the rapid discharge of the capacitors CA.

This makes it possible to compare the voltage threshold given by Pashchen's Law and that delivered by the high voltage generator.

Control of the impedance Z of the reactor

The recording and the analysis of the signals concerning the voltage at the terminals of the reactor and the electrical discharge current which passes through the circuit makes it possible to determine the impedance Z of the charge (reactor) from the phase shifting between the two signals and which depends on the components of the electric circuit in question as well as on the material and/or product processed.

For an operation of the polyfunctional method with constant impedance Z, it is sufficient to modify the inter-electrode distance in the reactor using an automated motorisation system and included in said control system.

Automatic device for pressure, temperature and UV sensors, chromatograph and mass spectrometer To the polyfunctional system is associated measuring and analysis devices: pressure sensors PS, thermocouples CT, UV radiation detectors (capUV), chromatograph analyser CH, mass spectrometer MS, etc. The control for these means of measuring and analysing is provided by the intermediary of the numerical control NC of the control system of the polyfunctional system.

1.4. Detection of UV radiation, Chromatography and Mass Spectrometry

UV Radiation

The analysis of the signals for detecting UV radiation emitted by the electric arcs which are triggered in the spark gaps (connecting the capacitors) and between the electrodes introduced into a reactor make it possible to know if said polyfunctional system is operating and in particular if the discharge of the high voltage capacitors has occurred. These signals in question are transmitted toward the control system via fibre optics in order to avoid disturbances caused by the electromagnetic field which is present during the operation of said polyfunctional system.

When the control system has detected, through this information, the non-discharge of capacitors, it controls the grounding of all of the capacitors in order to discharge them and avoid the risk of damaging them. This reduces the intervention and maintenance cost of said polyfunctional method.

Chromatography/Mass Spectrometry

During the processing of the materials and/or products by the polyfunctional system, gases are generated through the chemical reactions (for example $H_2S$).

The analysis of these gases by a chromatograph and a mass spectrometer during the unfolding of the tests makes it possible to deliver information concerning the state of the progress of the crushing, fragmentation and separation of the elements constituting the materials and/or products processed.

The analysis of a portion of the materials and/or products during processing by the polyfunctional system in real time or after the stopping of the electrical discharges by chromatography and mass spectrometry (FIGS. 7*a* and 7*b*) makes it possible to obtain information in particular used to optimise the energy injected into the reactor by limiting or stopping the electrical discharges. They can also be used to automate the loading and the unloading of the reactors. FIGS. 7*a* and 7*b* show peaks corresponding to given carbon chains.

FIG. 7*a* shows a qualitative analysis of asphaltic sand after processing by the polyfunctional system, peaks are observed which correspond to hydrocarbons having a certain number of carbon/carbon bonds.

FIG. 7*b* shows an analysis by gas chromatography combined with a detection via mass spectrometry, the presence is observed of a peak corresponding to compounds between C20 and C40.

For example, the system can include a database which collects for given products grading curves according to the rates of gaseous releases measured, energy deployed, the number of firings (electric discharges) and gases generated.

Other Measurements

The measurement of the pressure inside the reactor at a few points makes it possible to evaluate the effect of the shockwave generated taking into account the mechanical characteristics of the materials and/or products to be processed or to be reused.

The products obtained are furthermore analysed by laser granulometry or on a nest of screens with decreasing granulometry (varying between a few μm and a few mm).

In the case of applications (example: ores and minerals, sand and bituminous shale, etc.) where the polyfunctional system generates gases such as hydrogen sulphide $H_2S$ during the reusing of said materials and/or products, the recovery of this gas and the measurement of its concentration makes it possible to have substantial elements on the state of crushing and on the fragmentation of the materials and/or products. If the concentration of this gas tends to stabilise, this can be explained by the fact that the separation of the element of sulphur present in the materials and/or products has reached its optimum.

2. Examples of Specific Applications of the Polyfunctional System

2.1. Fragmentation and Crushing of Diamond Powder

This specific application of the polyfunctional system has already been presented in patent application FR 09 50945, not yet published.

Currently the crushing of abrasive diamond powder is done by attrition in specific crushers. The duration of crushing in order to obtain a granulometry of a magnitude of 20 microns is greater than about twenty hours. It is practically impossible to obtain diamonds of nanometric dimensions in sufficient quantities via these conventional methods.

The use of the polyfunctional system causes an electrokinetic fragmentation by dilatation and an "explosive" pulse constraint on the diamond crystals processed, causing them to burst into splinters with a very high rate of abrasivity. The processing time to obtain 50% of the grains at a size less than 50 μm is of a magnitude of a few minutes. In light of the mode of abrasion by scaling of the diamond, the final granulometry is limited only by the duration and the number of pulses. It is therefore perfectly possible to create diamond powders of nanometric size via this technique.

The diamond powder is subjected to mechanical shockwaves (Stage 1) in order to break the fragile particles, then to the passing of electric arcs (Stage 2) in order to fragment the hardest particles. The result is the fragmentation, micronisation and nanonisation of the diamond particles.

A flotation of a few very fine particles of diamond is observed, this is due to the phenomena of capillarity and wettability. The addition of surfactant products allows for the migration of these diamond particles to the bottom of the reactor in order to better expose them to the electric arc and to the shockwave, giving a better fragmentation and a better crushing of the diamond powder.

By way of example, the energy deployed for the prior processing of the diamond powder (diameter between 400 and 500 μm) in the reactor of the stage 1 is of a magnitude of 4,000 J by electrical discharge, after an application of 50 electrical discharges, the diamond powder recovered is introduced into the reactor of the stage 2 in order to undergo 1,000 pulses of an energy of 800 J per pulse.

The operating frequencies (recurrence) in the stages 1 and 2 are respectively of a magnitude of 0.5 Hz (stage 1) and 5 Hz (stage 2).

The dead time between two consecutive electrical discharges is of a magnitude of 500 ms for the stage 1 and 900 ms for the stage 2 (which allows the fine particles of diamond to group together and to reach the bottom of the reactor in order to favour the action of the electric arc and the mechanical effect of the shockwave on the particles of the diamond).

Surfactant products are added to the ambient liquid, in order to overcome the effects of wettability and capillarity.

A system of streams of water inside reactors prevents or limits the contact of the diamond particles with the cathode and reduces the processing of impurities.

The cathode is characterised by ferromagnetic properties that make possible a processing of the separation of impurities via a magnetic field.

A granulometry less than 20 μm is solicited and is reached very rapidly (2 minutes environ).

The degree of abrasivity of the diamonds increases as the fragmentation occurs by reducing the granulometry of the particles (table 1).

The median A/R of the degree of abrasivity of the diamonds is of a magnitude of 1.39 for diamonds of a size of 180 μm to 300 μm; it changes to 1.55 for a granulometry of 50 μm to 70 μm and it reaches 1.63 for diamonds of sizes between 20 μm and 50 μm (see table 1).

FIG. 8 shows the grading curve of the fragmentation of the powder of the diamond by the polyfunctional system, the presence of two Gaussian shapes on the curve is explained by the realisation of two granulometric analyses: one for particles having a granulometry less than 180 μm and the other for particles of which the granulometry is greater than 180 μm.

2.2. Fragmentation for the Obtaining of Nanoparticles

This invention proposes to adapt the system and the device described in patent application FR 09 50945, not yet published in order to obtain materials on a nanometric scale.

A specific application of the polyfunctional system is the production of nanoparticles, and more particularly the production of nanodiamonds.

As mentioned previously in the framework of the diamond powder, the polyfunctional system makes it possible to obtain a powder on a micrometric scale. This application can be generalised to many materials other than diamond powder, by way of example, the following can be mentioned: oxides (titanium oxide TiO, titanium dioxide $TiO_2$ TiON (nitrogen-doped), TiCON (nitrogen- and carbon-doped)). These materials on a nanometric scale can be used in diverse applications: electronics, optics, photocatalysis, biotechnology, etc. The $TiO_2$ in the form of nanometric grains could replace Silicon in certain cases (photovoltaic cells). The doping of these oxides with nitrogen and carbon make it possible to improve their potential for better effectiveness in the applications mentioned hereinabove.

It furthermore makes it possible to go beyond this micrometric scale, and to obtain a powder of which the particles are at the nanometric scale.

In the application relating to the production of nanoparticles, the energy of an electrical discharge can vary between 100 joules and 1,200 joules, or more precisely between 200 and 1,000 joules for the stage 2 with direct effect, and between 1,000 joules and 15,000 joules, or more precisely between 2,000 and 12,000 joules for the stage 1 with indirect effect.

In the stage 1, the duration of a discharge is of a magnitude of a few hundred microseconds, although it is of a magnitude of a few tens of microseconds in the stage 2.

The pulse recurrence frequency varies between 0.5 and 2 Hz, more precisely between 0.5 and 1 Hz for the stage 1 and between 1 and 20 Hz for the stage 2.

The dead time between two consecutive electrical discharges varies between 1 ms and 1 s, or more precisely between 10 ms and 1 s.

The switching time for a discharge of a succession of discharges is between 250 ns and 2 μs or more precisely between 300 ns and 900 ns.

2.2.1. Structure of the Cooling Tank:

The crushing of the diamond results in a substantial thermal elevation of the water (or more generally of the liquid used as the ambient medium), which therefore poses the question of the cooling of the reactor, and more particularly of the ambient liquid.

Indeed, he energies implemented to pass from the micrometric scale to the nanometric scale result in a very substantial increase in the temperature, although with the energies that come into play to reach the micrometric scale, the cooling of the reactor is not required.

To this effect, specific tanks have been developed making it possible to constantly cool the ambient liquid. These tanks are shown in FIG. 9.

The use of an adapted cooling system makes it possible to improve the output of the device, by limiting dead time.

FIG. 9 shows a reactor for the production of nanoparticles with a cooling system of the electrodes.

The reactor typically has a polyhedron shape, or cylindrical with a spherical bottom.

The device shown comprises an anode with a tip E1, E2, E3, and a flat cathode E'1, E'2, E'3 (device of the tip/flat type, such as described hereinabove).

The cathode E'1, E'2, E'3 is cooled by means of a conventional cooling loop, by circulating a fluid in a conduit 50 in and around the cathode E'1, E'2, E'3, this fluid being injected into the conduit 50 by an inlet 52, and exiting via an outlet 54 carrying it to means of cooling 56 such as those known to skilled in the art, before being reinjected in order to cool the cathode E'1, E'2, E'3.

For the cooling of the anode, a fluid is injected through the inlet 22 of a conduit 20 which passes through the anode E1, E2, E3, then passes through the outlets 24 of said conduit 20. The cooling fluid is then located in the core C(i,j) of the reactor R(i,j). The cooling fluid can then pass through outlet pipes 30, said outlet pipes 30 having inlets 32 arranged along the anode E1, E2, E3, and serving to cause the fluid to exit from the core of the reactor R(i,j), in order to carry it via an outlet 34 into a cooling and filtering circuit 40 such as known by those skilled in the art, before being reinjected to cool the anode E1, E2, E3.

Furthermore, the inlets 32 can be influenced, and in particular the size of these inlets in order to choose the particles that pass through the filtration system.

Indeed, the crushing results in a suspension of elements in the ambient liquid. The settling rate of these elements depends on their size; the greater the size of the particles, the faster they settle (gravitation and Stokes' law).

The size of the particles that will be captured by the pipes 30 then by the filtration system 40 can then be determined, by placing the inlets 32 of the pipes 30 at a height adapted to the settling rate corresponding to the particle diameter desired.

The particles of a greater diameter will therefore not be captured, and remain in the ambient liquid (at a height lower than that of the inlets 32 of the pipes 30), in order to be subjected to additional shockwaves and electric arcs, in order to be reduced until they reach the desired granulometry.

Another embodiment possible is a carousel cooling system.

Contrary to the device shown in FIG. 9, a device provided with a carousel cooling system is not going to operate continuously.

More precisely, the functional system operated here in an alternating manner. The device comprises several tanks wherein are carried out the operations such as the crushing by direct effect and the crushing by indirect effect.

The operations are carried out sequentially; for example, when the crushing by indirect effect is carried out in a first tank, the other tank or tanks are cooled. The crushing by direct effect is then carried out in one of the tanks cooled beforehand, while the tank that had served for the crushing by indirect effect is cooled in turn.

2.2.2. Application Specific to the Production of Nanodiamonds

Nanodiamonds are elements used in the medical field, for example as tracers. Diamond particles of which the size is of a magnitude of the nanometer are irradiated in such a way as to be fluorescent once injected into the body of a subject.

Currently, the crushing of diamonds with the purpose of obtaining nanodiamonds is carried out by means of conventional crushers. Such a crushing however has disadvantages in terms of output, cost and duration.

Another method is based on streams of air, but the crushing by this technique is limited to one granulometry, i.e. it does not make it possible to go below 100 nanometers. The output in this case is very low and other problems concerning the recovery of the nanoparticles arise.

Indeed, the operations of crushing and irradiation are currently carried out separately. In addition, the output from such a crushing is very low, of a magnitude of 10% of the diamond particles are crushed to the size of a magnitude of the nanometer.

Moreover, the use of the polyfunctional system allows for substantial savings in terms of cost; indeed, the conventional means for the crushing of diamond results in very substantial energy expenses over periods of time of a magnitude of one week. The polyfunctional system substantially reduces the time requires to obtain nanodiamond particles, which as such reduces the cost of the crushing.

The use of the polyfunctional system makes it possible to overcome these disadvantages.

The polyfunctional system makes it possible to crush the diamond particles; as mentioned previously, the first stage with indirect effect (shockwaves) makes it possible to weaken the resistance of the diamond, while the second stage with direct effect (electric arcs) will carry out the crushing itself.

The diamond particles have a tendency to become more fragile after the exposure to electrical discharges, as such there is a threshold of energy delivered to these particles (corresponding to a number of discharges in the reactor) from which their fragmentation accelerates brutally.

The analyse of the hardness of the diamond particles (Syndia, Grade: CD-FS 40/45) shows that the particles with a granulometry of 50 micrometers obtained after crushing by Xcrusher have a hardness 40% less than those of the reference (before crushing). On the average the hardness of the particles after crushing by electrical discharges drops 30%.

Moreover, during the electrical discharges produced in the reactor, the electrons (relativistic) have a very high kinetic energy, of a magnitude of 0.5 to 1 MeV, which makes it possible to irradiate the diamond particles after the impact, giving the phenomenon of luminescence. These luminescent diamond nanoparticles can be used as markers in biology and in medicine and which presents an interest for scientists and industrialists. There is therefore conjointly crushing (nanonisation) and irradiation of the diamond due to the electric arc.

This phenomenon of luminescence of nanoparticles is due to the presence of NV colour centres comprised of an atom of nitrogen (impurity present in the diamond) and of a vacancy which takes the place of an atom of carbon, generated by the passing of the electrons during the electrical discharge; as such the excitation of these NV centres results in the emission of a light.

In this method, the irradiation is carried out in a liquid solution, which cannot be carried out in the state of the art.

The diamond particles irradiated as such can then be used for biomedical tracing thanks to their luminescence.

The steps of crushing and of irradiation are therefore carried out conjointly without requiring an additional step.

The invention claimed is:

1. Method for reusing materials by pulsed power, said method to obtain particles on a nanometric scale, the method comprising:

a first step of generating first succession of electrical discharges between at least two electrodes in a reactor receiving an ambient liquid as well as materials to be reused, the first succession of electrical discharges producing, due to the energy of the electrical discharges, the frequency of the electrical discharges, a voltage between the electrodes and a switching time, a mechanical shockwave which propagates on the materials to be processed in the reactor, and, cooling said ambient liquid by a continuous or carousel cooling system.

2. Method according to claim 1, comprising, after the producing the mechanical shockwave, a second step of generating a second succession of electrical discharges of which the energy, the intensity, the voltage between the electrodes that generate the electrical discharges, a switching time and a discharge frequency are chosen such that said discharges carry out a crushing of said material by direct effect of the electrical discharges, said electrical discharges generating electric arcs passing through the materials to be reused.

3. Method according to claim 2, comprising a step of collecting materials resulting from the crushing according to the diameter of the particles by the cooling system, said materials resulting from the first and the second step of crushing being in suspension in the ambient liquid.

4. Method according to claim 2, comprising a third step of drying of the materials via thermal induction due to a generation of microwaves is implemented, said third step of drying intervening at the end of the first and second steps.

5. Method according to claim 2, wherein the energy of an electrical discharge of the second succession of discharges producing the crushing of material by direct effect of electric arcs is between 100 joules and 1,200 joules.

6. Method according to claim 2, wherein the operating frequency of the second succession of discharges producing the crushing of material by direct effect of electric arcs is between 1 Hz and 20 HZ.

7. Method according to claim 2, wherein a dead time between two consecutive electrical discharges of the first or second succession of discharges varies between 1 ms and 1 s.

8. Method according to claim 2, wherein the switching time of a discharge of the first or second succession of discharges is between 250 ns and 2 μs.

9. Method according to claim 2, wherein the energy of an electrical discharge of the second succession of discharges producing the crushing of material by direct effect of electric arcs is between 200 joules and 1,000 joules.

10. Method according to claim 2, wherein the operating frequency of the second succession of discharges producing the crushing of material by direct effect of electric arcs is between 5 Hz and 20 Hz.

11. Method according to claim 2, wherein the dead time between two consecutive electrical discharges of the first or second succession of discharges varies between 10 ms and 1 s.

12. Method according to claim 2, wherein the switching time of a discharge of the first or second succession of discharges is between 300 ns and 900 ns.

13. Method according to claim 2, wherein the energy, the intensity, the tension between the electrodes that generate them, the switching time and the discharge frequency are also chosen such that the kinetic energy of the electrons emitted during the crushing of said material by direct effect of the electrical discharges is between 0.5 MeV and 1 MeV.

14. Method according to claim 1, wherein the energy of an electrical discharge of the first succession of discharges producing a mechanical shockwave is between 1,000 joules and 15,000 joules.

15. Method according to claim 1, wherein the operating frequency of the first succession of discharges producing a mechanical shockwave is between 0.5 Hz and 2 Hz.

16. Method according to claim 1, wherein the material reused is diamond powder, for the obtaining of irradiated diamond nanoparticles by irradiation, said irradiated nanoparticles being luminescent.

17. Method according to claim 1, wherein the energy of an electrical discharge of the first succession of discharges producing a mechanical shockwave is between 5,000 joules and 12,000 joules.

18. Method according to claim 1, wherein the operating frequency of the first succession of discharges producing a mechanical shockwave is between 0.5 Hz and 1 Hz.

* * * * *

UNITED STATES PATENT AND TRADEMARK OFFICE

CERTIFICATE OF CORRECTION

PATENT NO. : 9,120,102 B2
APPLICATION NO. : 13/392070
DATED : September 1, 2015
INVENTOR(S) : Abdelaziz Bentaj et al.

It is certified that error appears in the above-identified patent and that said Letters Patent is hereby corrected as shown below:

On the Title Page, in Item [75] under Inventors, at line 2, please delete "Quayahya" and insert --Ouayahya--.

Signed and Sealed this
Fifth Day of July, 2016

Michelle K. Lee

Michelle K. Lee
*Director of the United States Patent and Trademark Office*